US007094072B2

(12) United States Patent
Takase et al.

(10) Patent No.: US 7,094,072 B2
(45) Date of Patent: Aug. 22, 2006

(54) CONNECTOR HOLDING STRUCTURE

(75) Inventors: Toru Takase, Shioya-gun (JP); Tadao Kuboki, Shioya-gun (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/157,796

(22) Filed: Jun. 22, 2005

(65) Prior Publication Data

US 2005/0287840 A1 Dec. 29, 2005

(30) Foreign Application Priority Data

Jun. 24, 2004 (JP) ..... 2004-186620

(51) Int. Cl.
*H01R 12/00* (2006.01)

(52) U.S. Cl. ..... 439/76.1; 361/752; 439/79

(58) Field of Classification Search ..... 439/76.1, 439/607, 554, 79, 892; 361/752, 756, 758
See application file for complete search history.

(56) References Cited

U.S. PATENT DOCUMENTS 5,637,014 A 6/1997 Sukegawa et al. ..... 439/607
2003/0096517 A1 5/2003 Ho ..... 439/79
2003/0207613 A1 11/2003 Chen ..... 439/554
2005/0287841 A1* 12/2005 Kitamura ..... 439/76.1

FOREIGN PATENT DOCUMENTS

JP 09-321462 12/1997
JP 2001-237557 8/2001

* cited by examiner

*Primary Examiner*—Michael C. Zarroli
(74) *Attorney, Agent, or Firm*—Squire, Sanders & Dempsey L.L.P.

(57) ABSTRACT

In a structure for holding a connector mounted on an electronic circuit board inserted and housed in a case, there are provided a resin claw formed on the connector, a hole formed on the electronic circuit board and receiving the claw to be engaged therewith, a pair of rails formed on an external wall of the connector to protrude in a direction parallel with a direction in which the connector is inserted in the case, and a second rail formed on an internal wall of the case to protrude in the direction in which the connector is inserted, so as to engage with the rails, thereby enabling the connector to be fixed on the board without the use of screws, while ensuring an excellent resistance against twist or shake applied to the connector when a mating connector is inserted to and removed from the connector mounted on the board.

5 Claims, 7 Drawing Sheets

CONNECTOR HOLDING STRUCTURE

BACKGROUND OF THE INVENTION

1. Field of the Invention

The present invention relates to a connector holding structure for holding connectors on an electronic circuit board housed in a case.

2. Description of the Related Art

In an electronic circuit unit comprising an electronic circuit board, on which a connector is mounted, that is housed in a case, it is required that the connector is tightly fixed to the board, and mechanical and electrical connections between the connector and the electronic circuit board do not become unstable when a mating connector is inserted to and removed from the connector mounted on the electronic circuit board.

Further, in the manufacturing (assembly) process of the electronic circuit unit, it is desirable that the electronic circuit board on which a connector is mounted is easily inserted into a case, and the electronic circuit board is fixed at a predetermined position with high accuracy.

For this reason, as taught in Japanese Laid-Open Patent Application No. Hei 9(1997)-321462 (paragraphs 0010 and 0011, FIG. 1, etc.), a connector is fixed to an electronic circuit board by fastening with screws and soldering its lead terminals on the board. In addition, raised strips are integrally formed on the upper surface of the connector, and the raised strips are engaged between a pair of external force-receiving projections disposed on the internal surface of a case.

With this, when a mating connector is inserted to or removed from the connector mounted on the electronic circuit board, an excessive external force is not applied to the screwed and soldered portions of the connectors (stress is not generated), since, even if the connectors are twisted or shaken to be moved, the movement thereof is restricted by the raised strips coming into contact with the external force-receiving projections, whereby the mechanical and electrical connections between the connectors and the electronic circuit board are stabilized.

In the technique taught in Japanese Laid-Open Patent Application No. 2001-237557 (paragraphs 0032 to 0034, FIG. 2, etc.), flange-like projections 132 are protruded from surfaces 118*a* of connectors 118 (surfaces opposite to the surface facing an electronic circuit board 116) to be engaged with recesses 134 formed in a housing case main body 128; and rails 130 are formed on the inner wall of the housing case main body 128, for guiding the electronic circuit board 116, as shown in FIG. 11.

The connectors 118 are fixed to the electronic circuit board 116 by their soldered lead terminals; and after the electronic circuit board 116 has been inserted in the housing case main body 128 while being guided by the rails 130, and fixed at a predetermined position, the projections 132 engage the recesses 134. The electronic circuit board 116 with the connectors 118 is thereby easily inserted into the housing case main body 128, and the electronic circuit board 116 is fixed at a predetermined position, whereby the mechanical and electrical connections between the connectors 118 and the electronic circuit board 116 are stabilized.

In the technique disclosed in '462, since it is configured such that the connectors are fixed to the electronic circuit board by screws, a relatively high level of yield strength against twist or shake (twist/shake yield strength) can be obtained when inserting the mating connectors to the connectors on the electronic circuit board or removing therefrom. However, this requires a screwing process and results in increase in labor cost and the number of components.

Further, in the technique disclosed in '557, since it is configured such that the lead terminals of the connectors 118 are soldered to the electronic circuit board 116, the process to fix the connector by screwing is not necessary. However, as shown in FIG. 11, the projections 132 are to be protruded from the side walls 118*a* of the connectors 118 in the insertion direction, and recesses 134 are to be formed at locations corresponding to the projections 132 on the housing case main body 128, i.e., the connections (boundary lines) of the connectors 118 and projections 132 and the connections of the housing case main body 128 and the recesses 134 are formed so as to be orthogonal to the insertion direction.

For this reason, the projections 132 should have a predetermined length (indicated by "L1" in FIG. 12) so as not to slip out from the recesses 134 if the twisting/shaking force is applied when mating connectors are inserted or removed, particularly when downward twisting/shaking force in the insertion direction is applied to the projections 132. Therefore, when the mating connectors are inserted to or removed from the connectors 118 and external force due to twist or shake in the direction of the arrow A of FIG. 12 is exerted on the connector 118, the resulting moment intensively acts on the base portions 132*a* of the projections 132, and the projections 132 deform in the manner shown by a phantom line in the figure.

As a result, the projections 132 are occasionally damaged and the connections between the connectors and the electronic circuit board are liable to be unstable due to an excessive external force (a stress) acting on the soldered portion of the lead terminals of the connectors 118.

In this case, it will be sufficient if resistance against twist or shake is strengthened, i.e., if the thickness t1 of the projections 132 is increased so as to prevent the projections 132 from deforming, but it brings a drawback that the thickness (height) t of the entire housing case is increased with increasing thickness of the projections 132.

SUMMARY OF THE INVENTION

Therefore, an object of the present invention is to solve the above-described drawbacks and to provide a connector holding structure that enables a connector to be fixed on an electronic circuit board without the use of screws, that enables the electrical circuit board on which the connector is inserted and housed in a housing case with ease and accuracy, while ensuring an excellent resistance against twist or shake applied to the connector when a mating connector is inserted to and removed from the connector mounted on the electronic circuit board.

In order to achieve the object, the present invention provides a structure for holding a connector mounted on an electronic circuit board inserted and housed in a case, comprising, a claw formed on the connector; a claw receiver formed on the electronic circuit board and receiving the claw to be engaged therewith; a first rail formed on an external wall of the connector to protrude in a direction parallel with a direction in which the connector is inserted in the case; and a second rail formed on an internal wall of the case to protrude in the direction in which the connector is inserted, so as to engage with the first rail.

DETAILED DESCRIPTION OF THE PREFERRED EMBODIMENT

The preferred embodiment of a connector holding structure according to the present invention will be described below with reference to the attached drawings.

Figure 1:
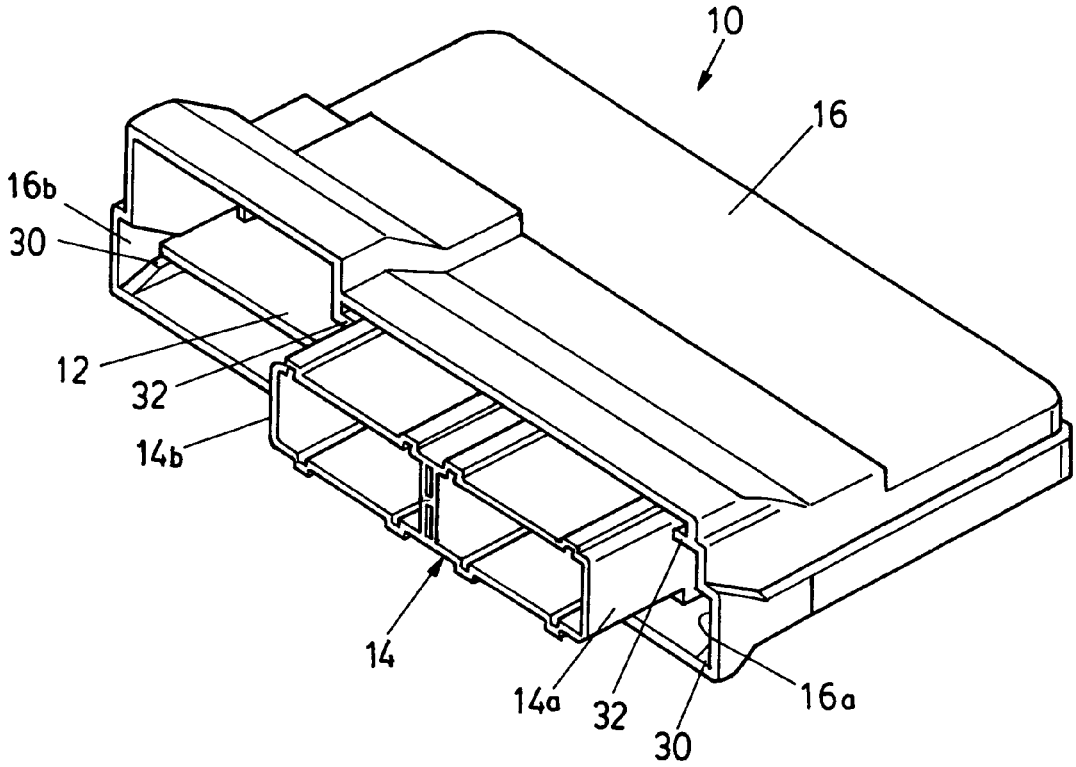
FIG. 1 is a perspective external view showing an electronic circuit unit provided with a connector holding structure according to an embodiment of the present invention.
Figure 2:
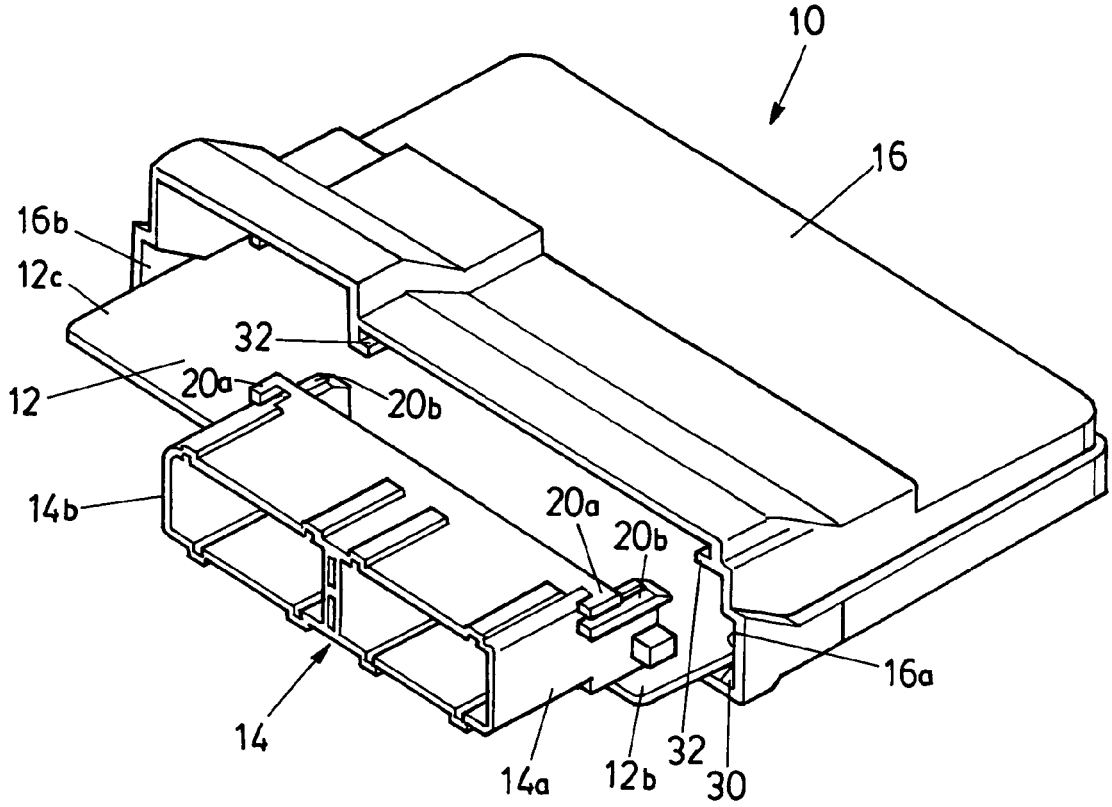
FIG. 2 is an exploded perspective view similar to FIG. 1, showing the electronic circuit unit shown in FIG. 1.

FIG. 1 is a perspective external view showing an electronic circuit unit provided with the connector holding structure according to the embodiment of the present invention; and FIG. 2 is an exploded perspective view similar to FIG. 1, showing the electronic circuit unit.

In FIGS. 1 and 2, a reference numeral 10 designates the electronic circuit unit. The electronic circuit unit 10 comprises an electronic circuit board 12 (hereinafter simply referred to as "board"), a connector 14 mounted on the board 12, and a case 16 in which the board 12 with the mounted connector 14 is housed.

Figure 3:
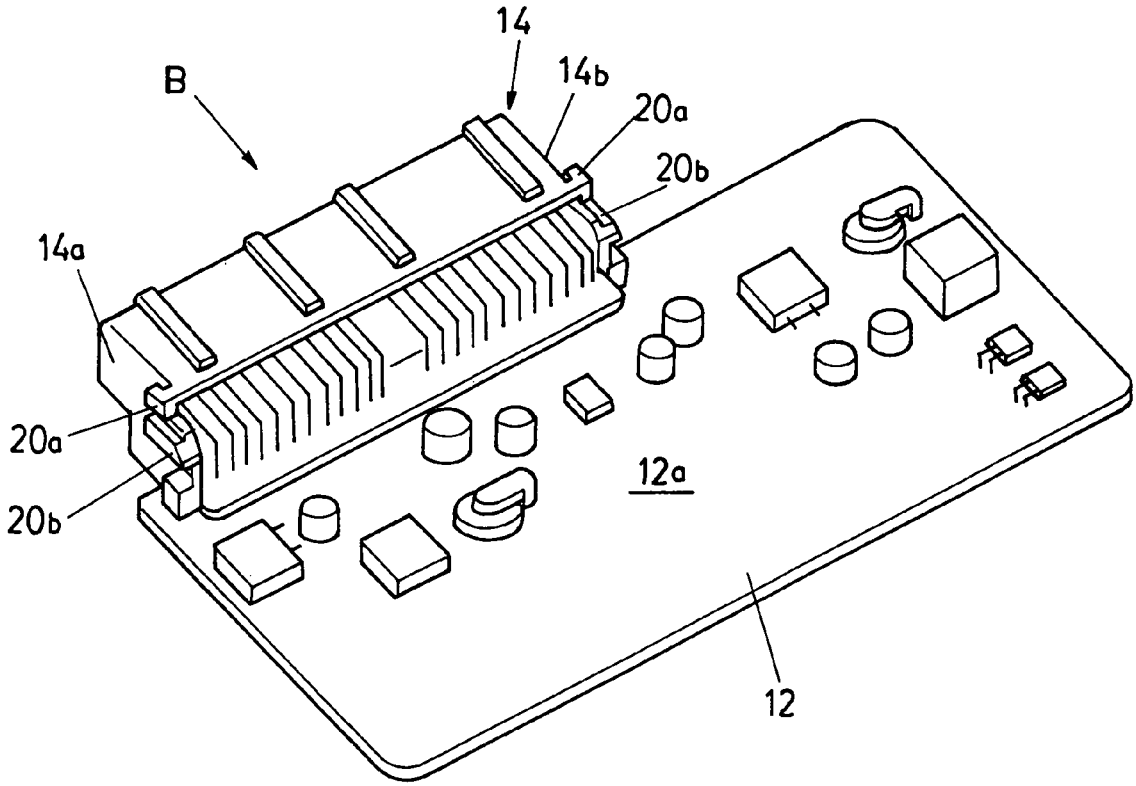
FIG. 3 is a perspective view showing a board on which a connector of FIG. 1 is mounted.

FIG. 3 is a perspective view showing the board 12 on which the connector 14 is mounted. IC chips, capacitors, and other electronic components are mounted together with the connector 14 on the mounting surface 12*a* of the board 12. In the other drawings, the electronic pars mounted on the board 12 are omitted from illustration to simplify the figures. The connection terminals disposed inside the connector 14 are also omitted from illustration.

The connector 14 is made of resin and is mechanically and electrically connected to external equipment (not shown) through a mating connector or the like. Two connector-side rails 20*a* and 20*b* parallel with the insertion direction are integrally protruded from the external walls of the connector 14, specifically, from the side walls 14*a* and 14*b* on the opposite sides constituting the side surfaces of the connector 14 when viewed from the insertion direction (arrow B in FIG. 3) with respect to the case 16, as shown in FIGS. 2 and 3 (The connector-side rail of the upper portion in the vertical direction is designated 20*a*, and the connector-side rail of the lower portion is designated 20*b*). Therefore, the connections (boundary lines) of the connector 14 and connector-side rails 20*a* and 20*b* are parallel with the insertion direction of the connector 14.

The spacing between the two connector-side rails 20*a* and 20*b*, more specifically, the distance from the lower surface of the connector-side rails 20*a* to the upper surface of the connector-side rails 20*b* is suitably established in accordance with the size (thickness) of the case-side rail (described later) formed in the case 16. The connector-side rails 20*b* are formed so as to be substantially twice the length of the connector-side rails 20*a*, and the distal portions thereof (distal sides in the insertion direction) are formed with a tapered shape. The length, width, and thickness (height) of the two connector-side rails (first rail(s)) 20*a* and 20*b* (with respect to the insertion direction) are appropriately determined taking into account the twisting/shaking force applied to the connector-side rails 20*a* and 20*b* when inserting and removing the mating connectors (not shown).

Figure 4:
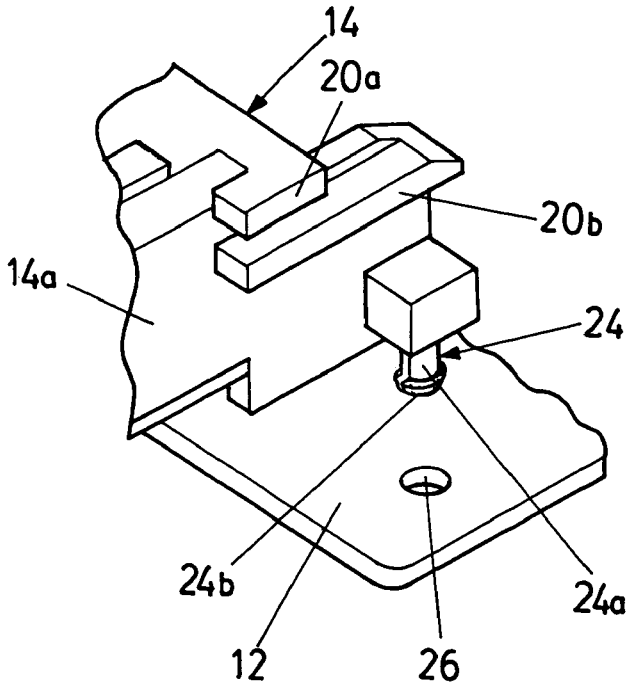
FIG. 4 is a partial enlarged perspective view showing the state prior to the connector of FIG. 1 being mounted (fixed) on the board.
Figure 5:
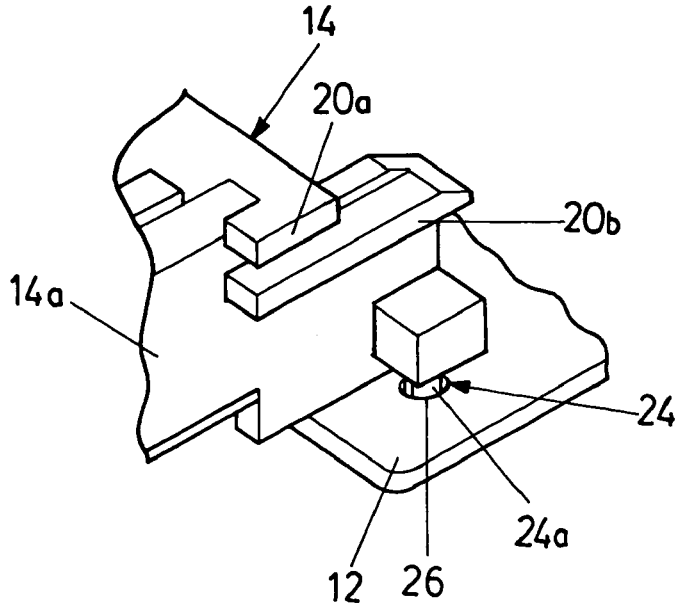
FIG. 5 is a partial enlarged perspective view similar to FIG. 4, showing the state in which the connector of FIG. 1 has been mounted (fixed) on the board.

FIG. 4 is a partial enlarged perspective view showing the state prior to the connector 14 being mounted (fixed) on the board 12, and FIG. 5 is a partial enlarged perspective view similar to FIG. 4, showing the state in which the connector 14 shown in FIG. 4 has been mounted (fixed) on the board 12.

As shown in FIGS. 4 and 5, a resin claw (or leg) 24 is formed at the lower portion of the side wall 14*a* of the connector 14, and a claw engagement hole (claw receiver) 26 which receives the resin claw 24 to be engaged therewith, is formed in a position on the board 12 where the engagement with the resin claw 24 is possible.

Following is a detailed description of the shapes and fixing method of the resin claw 24 and the claw engagement hole 26.

Figure 6:
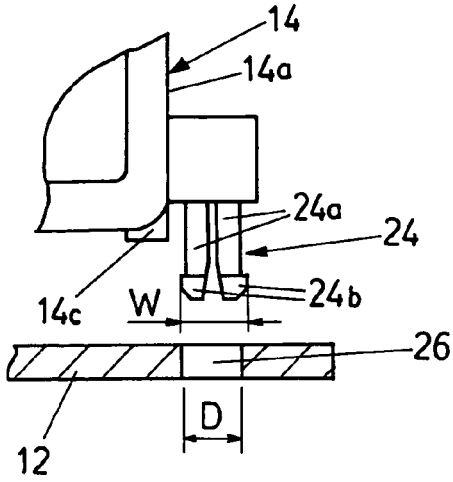
FIG. 6 is a schematic view showing, with the board cross-sectioned, the state prior to a resin claw of the connector being installed on the board.
Figure 7:
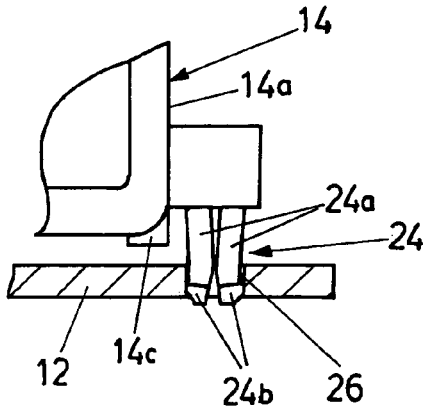
FIG. 7 is a schematic view similar to FIG. 6, showing the state in which the resin claw of the connector is being inserted into a claw engagement hole of the board.
Figure 8:
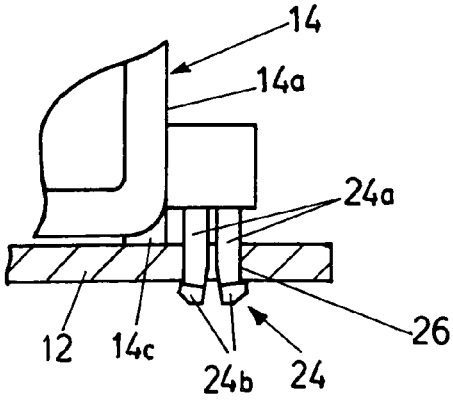
FIG. 8 is a schematic view similar to FIG. 6, showing the state in which the resin claw of the connector is completely inserted into the claw engagement hole of the board.

FIG. 6 is a schematic view showing, with the board cross-sectioned, the state prior to the resin claw 24 of the connector 14 being installed on the board 12, FIG. 7 is a schematic view showing the state in which the resin claw 24 of the connector 14 is being inserted into the claw engagement hole 26 of the board 12, and FIG. 8 is a schematic view showing the state in which the resin claw 24 of the connector 14 is completely inserted into the claw engagement hole 26 of the board 12.

The resin claw 24 is shaped as a cylinder divided into two sections (half cylindrical shape) along the center in the radial direction, and has a plurality of (specifically, two) elastically deformable leg portions 24*a*, and claw portions 24*b* formed on the distal ends (lower end portions) of the leg portions 24*a*, as shown in FIG. 6.

The external dimension in the width direction of the resin claw 24 in the free state, shown in FIG. 6, more specifically, the external dimension W of the claw portions 24*b* is made slightly larger than the diameter D of the claw engagement hole 26 on the board 12.

When the connector 14 is fixed to the board 12, the resin claw 24 of the connector 14 is positioned above the claw engagement hole 26 of the board 12 (also refer to FIG. 4), and the resin claw 24 is thereafter inserted in the claw engagement hole 26.

Then, the resin claw 24 is inserted into the claw engagement hole 26 as the spacing (gap) between leg portions 24*a* of the resin claw 24 is narrowed, in other words, as the resin claw 24 (leg portions 24*a*) undergoes elastic deformation, as shown in FIG. 7.

When the claw portions 24*b* reach the lower side of the claw engagement hole 26, the leg portions 24*a* that have been narrowed by being restricted in the claw engagement hole 26 (pressed by the edge of the claw engagement hole 26 and deformed inward) are spread apart, as illustrated in the figure, by the elastic force possessed by the resin material itself, and the claw portions 24*b* of the leg portions 24*a* are engaged (stopped) by the edge of the claw engagement hole 26 on the lower side of the board 12, as shown in FIG. 8.

The resin claw 24 of the connector 14 is shown in FIGS. 4 to 8 only for one side wall 14*a* of the connector 14, but a similar resin claw 24 is also formed on the side wall 14*b* on the opposite side, and a claw engagement hole 26 corresponding thereto is formed in the board 12. The resin claws 24 and the claw engagement holes 26 are brought into engagement with each other in two locations on the side walls of the connector 14. The connector 14 is thus fixed to the board 12 by the resin claws 24 and the claw engagement holes 26, and is further fixed by soldering the lead terminals of the connector 14 to the board 12.

Projections 14*c* formed on the lower surface of the connector 14 are adapted to be in contact with the upper surface of the board 12, as shown in FIG. 8, when the connector 14 is fixed to the board 12, so that the connector 14 is more stably fixed.

The case 16 will be described next.

Figure 9:
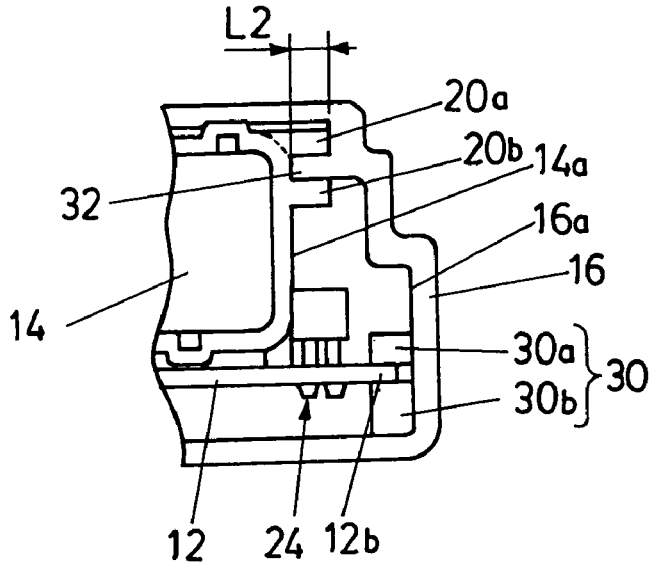
FIG. 9 is a partial enlarged front view seen from the insertion direction of the electronic circuit unit.
Figure 10:
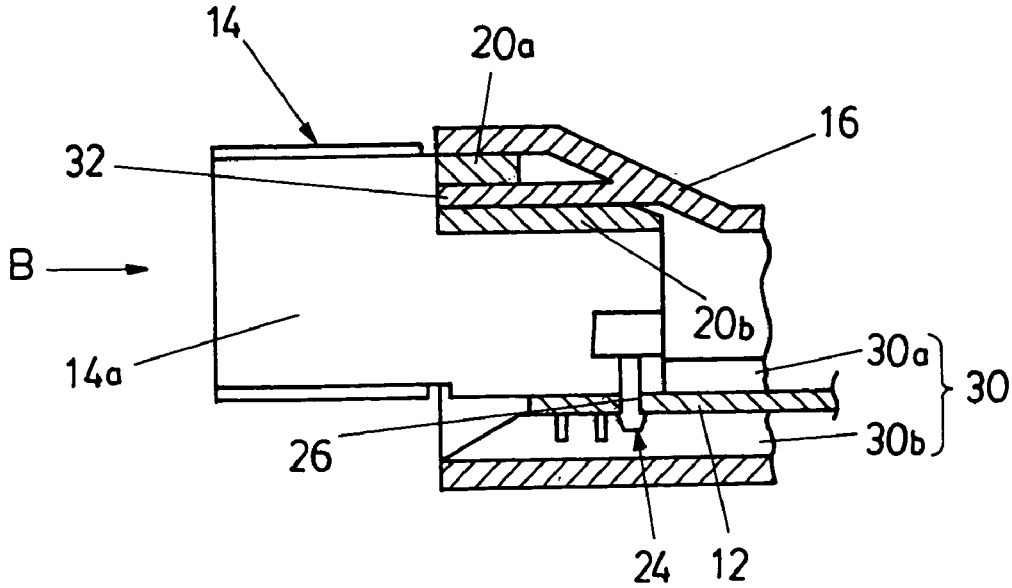
FIG. 10 is a partial enlarged schematic cross-section showing the engagement portion of the case and board on which the connector is mounted.

FIG. 9 is a partial enlarged front view seen from the insertion direction of the electronic circuit unit 10, and FIG. 10 is a partial enlarged schematic cross-section showing the engagement portion of the case 16 and board 12 on which a connector 14 is mounted.

The case 16 is made of resin, and board guides 30 for guiding areas that contain two edges 12*b* and 12*c* of the board 12 are protruded from the internal walls 16*a* and 16*b* of the side surfaces of the case 16, as shown in FIGS. 2, 9, and 10.

The board guides 30 comprise upper and lower board guide rails 30*a* and 30*b*, as shown in detail in FIGS. 9 and 10, and the board guide rails 30*a* and 30*b* are protruded so as to be parallel with the insertion direction (direction of arrow B; The board guide rail of the upper portion in the vertical direction is designated 30*a*, and the board guide rail of the lower portion is designated 30*b*).

Although not shown, the board guide rails 30*a* and 30*b* are protruded so as to reach the inside surface of the rear side of the case 16, and are also formed on the internal wall of the case 16 in locations with which the edge of the board 12 makes contact (opposite side of the opening), so that the board 12 can be fixed in a predetermined location.

The ends (in the vicinity of the opening of the case 16) of the board guide rails 30*a* and 30*b* are formed in a tapered fashion so as to allow the board 12 to be easily inserted. The spacing between the two board guide rails 30*a* and 30*b*, more specifically, the distance from the lower surface of the guide rails 30*a* to the upper surface of the guide rails 30*b* is appropriately established in accordance with the thickness of the board 12.

A case-side rail (second rail) 32 with which the connector-side rails 20*a* and 20*b* are to be engaged when the board 12 on which the connector 14 is mounted is inserted into the case 16, is protruded at a location corresponding to the connector-side rails 20*a* and 20*b* of the connector 14 on the internal wall of the case 16 (in the vicinity of the opening) so as to be parallel with the insertion direction (direction of arrow B). Accordingly, the connections (boundary lines) of the case-side rail 32 and case 16 are parallel with the insertion direction of the connector 14. The width (indicated by "L2" in FIG. 9) and thickness (height) of the case-side rail 32 are appropriately determined in consideration of the twist or shake applied to the case-side rail 32 when the mating connector is inserted or removed.

With the above-described configuration, when the board 12 on which the connector 14 is mounted is being inserted in the case 16, the connector-side rails 20*a* and 20*b* of the connector 14 engage with the case-side rail 32 of the case 16, such that the connector 14 is surely held in the case 16. The board 12 with the connector 14 is thus fixed and housed in the case 16. Therefore, when the mating connector is inserted to or removed from the connector 14, the connector-side rails 20*a* and 20*b* and the case-side rail 32 can restrict the movement of the connector 14.

As stated above, the connector holding structure of the embodiment is provided with resin claws 24 formed on the connector 14 and claw engagement holes 26 formed on the board 12, and the connector 14 is fixed to the board 12 by engaging the claws 24 and holes 26 each other, thereby the connector 14 can be fixed to the board 12 without the use of screws. Therefore, a screwing process is not required and the number of components can be reduced.

Also there are provided the connector-side rails 20*a* and 20*b* protruded from the side walls 14*a* and 14*b* of the connector 14 so as to be parallel with the insertion direction of the connector 14, and case-side rail 32 protruded from the internal wall of the case 16 so as to be parallel with the insertion direction and designed to be engaged with the connector-side rails 20*a* and 20*b*.

Figure 11:
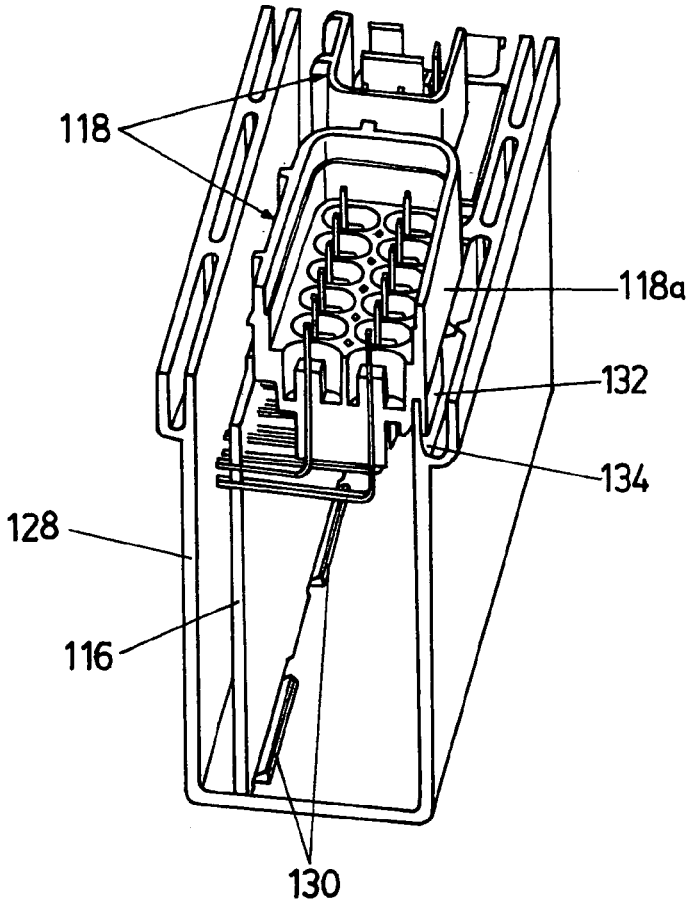
FIG. 11 is a perspective view to explain an example of a conventional connector holding structure.
Figure 12:
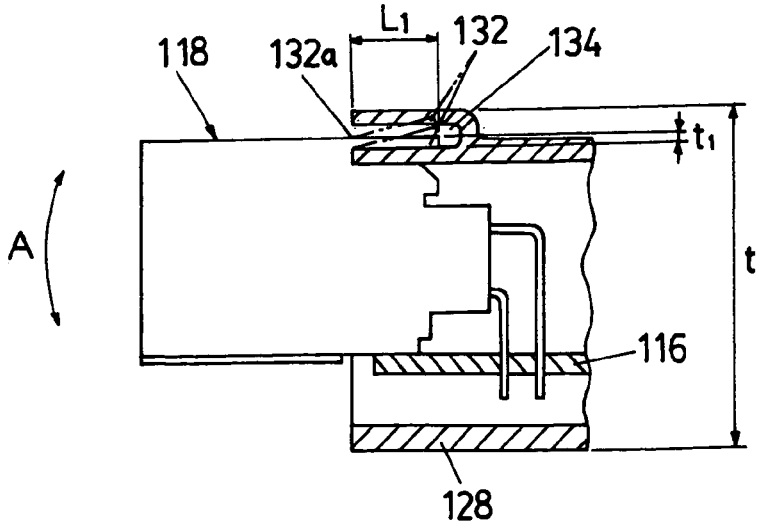
FIG. 12 is a partial enlarged schematic cross-section showing the connector holding structure shown in FIG. 11.

Therefore, the board 12 can be inserted and housed in the case 16 with ease and accuracy. Further, it becomes possible to improve the resistance against twist or shake applied to the connector 14 when the mating connector is inserted to or removed from the connector 14, even if the length of the place where the case-side rail 32 engages the connector-side rails 20*a* and 20*b* (more specifically, "L2" in FIG. 9) is made shorter than the conventional shape (the length "L1" of the projections 132) of FIG. 11.

Since it is configured such that the connections (boundary line) between the connector 14 and the connector-side rails 20*a* and 20*b*, and the connections (boundary line) between the case 16 and the case-side rail 32 are all parallel with the insertion direction of the connector 14, the above-described twisting/shaking force does not concentrate at a specific point of the connections of the connector 14 and the connector-side rails 20*a* and 20*b*. Therefore, it becomes possible to further improve the strength against twist/shake applied to the connector 14 when the mating connector is inserted to or removed from the connector 14.

Since it is configured such that the connector-side rails 20*a* and 20*b* of the connector 14 are formed in locations on the side surfaces of the connector 14 (side walls 14*a* and 14*b*) in the insertion direction, even if the thickness (height) of the connector-side rails 20*a* and 20*b* is increased to improve the strength against twist or shake, the thickness (height) of the entire case 16 is not increased. Therefore, in addition to the above effects, it becomes possible to enhance the strength or resistance against twist or shake applied to the connector 14 when the mating connector is inserted to or removed from the connector 14, without increasing the thickness (height) of the entire case 16.

In the above description, although an example is taken in which the connector 14 is a dual-type connector, the connectors fixed to the board 12 may be a plurality of single-type connectors, or a single connector alone.

It should further be noted that, although engagement is established between two connector-side rails 20*a* and 20*b* formed on the connector 14 and a single case-side rail 32 formed on the case 16, a reverse configuration may also be adopted in which a single connector-side rail and two case-side rails are engaged.

The present invention is configured such that the mounting surface 12*a* is the upper surface of the board 12, but the mounting surface is not limited to the upper surface of the board 12, and electronic components may also be mounted on the lower surface of the board 12.

The connector-side rails 20*b* are configured so as to have substantially double the length of the connector-side rails 20*a*, but it is apparent that the lengths of the connector-side rails 20*a* and 20*b* can be appropriately modified.

This embodiment is thus configured to have a structure for holding a connector (14) mounted on an electronic circuit board (12) inserted and housed in a case (14), comprising, a claw (resin claw 24) formed on the connector; a claw receiver (claw engagement holes 26) formed on the electronic circuit board and receiving the claw to be engaged therewith; a first rail (connector-side rails 20*a*, 20*b*) formed on an external wall (14*a*, 14*b*) of the connector (14) to protrude in a direction parallel with a direction in which the connector is inserted in the case; and a second rail (case-side rail 32) formed on an internal wall of the case to protrude in the direction in which the connector is inserted, so as to engage with the first rail.

In the structure, the first rail (20*a*, 20*b*) is formed at a location that corresponds to a side surface of the connector (14) in the direction in which the connector is inserted.

In the structure, the first rail comprises a pair of rails (20*a*, 20*b*) that engage with the second rail (32), and the pair of rails (20*a*, 20*b*) are made different in length.

In the structure, the claw (resin claw 24) is made of resin.

As described above, in the first embodiment of this invention, there is provided a connector holding structure for holding a connector (14) on an electronic circuit board (12) inserted in a case (16), comprising resin claws (24) formed on the connector (14), claw engagement portions (claw engagement holes 26) formed on the electronic circuit board (12) and designed to engage the resin claws (24), connector-side rails (20*a* and 20*b*) disposed in a protruding fashion parallel with the insertion direction of the connector (14) on the external walls (side walls 14*a* and 14*b*) of the connector (14), and case-side rail (32) disposed in a protruding fashion parallel with the insertion direction on the internal walls of the case (16) and designed to engage the connector-side rails (20*a* and 20*b*).

Another feature of this configuration is that the connector-side rails (20*a* and 20*b*) are formed in locations on the side surfaces of the connector (14) in the insertion direction.

Japanese Patent Application No. 2004-186620 filed on Jun. 24, 2004, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A structure for holding a connector mounted on an electronic circuit board, comprising:

a case housing the electronic circuit board and the connector;

a claw formed on the connector;

a claw receiver formed on the electronic circuit board and receiving the claw to be engaged therewith;

a first rail formed on an external wall of the connector to protrude in a direction parallel with a direction in which the electronic circuit board and the connector are inserted in the case to be housed therein; and a second rail formed on an internal wall of the case to protrude in the direction so as to engage with the first rail.

2. The structure according to claim 1, wherein the first rail is formed at a location that corresponds to a side surface of the connector in the direction in which the connector is inserted.

3. The structure according to claim 1, wherein the first rail comprises a pair of rails that engage with the second rail.

4. The structure according to claim 3, wherein the pair of rails are made different in length.

5. The structure according to claim 1, wherein the claw is made of resin.

* * * * *